US008162165B2

(12) United States Patent
Reed

(10) Patent No.: US 8,162,165 B2
(45) Date of Patent: Apr. 24, 2012

(54) PAIL AND CLOSURE

(75) Inventor: Angela M. Reed, Mableton, GA (US)

(73) Assignee: Bway Corporation, Atlanta, GA (US)

( * ) Notice: Subject to any disclaimer, the term of this patent is extended or adjusted under 35 U.S.C. 154(b) by 268 days.

(21) Appl. No.: 12/578,017

(22) Filed: Oct. 13, 2009

(65) Prior Publication Data

US 2011/0084074 A1 Apr. 14, 2011

(51) Int. Cl.
*B65D 17/34* (2006.01)
*B65D 41/34* (2006.01)

(52) U.S. Cl. ..... 220/270; 220/266; 220/288

(58) Field of Classification Search ..... 220/266, 220/270, 288; 215/330
See application file for complete search history.

(56) References Cited

U.S. PATENT DOCUMENTS 3,841,514 A 10/1974 Montgomery et al.
3,860,148 A * 1/1975 Sherin ..... 222/153.06
3,873,132 A 3/1975 Czerwiak
3,891,118 A 6/1975 Laurizio
3,998,355 A 12/1976 Galer
4,014,452 A 3/1977 Galer
4,034,886 A 7/1977 Galer
4,245,753 A 1/1981 Ellis
4,288,000 A 9/1981 Luker et al.
4,298,132 A 11/1981 Galer
4,413,743 A 11/1983 Summers
4,453,647 A 6/1984 Neat
4,456,136 A 6/1984 Pálsson
4,630,743 A 12/1986 Wright
4,666,054 A 5/1987 Jaicks
4,687,112 A 8/1987 Swartzbaugh
5,046,632 A * 9/1991 Bordner ..... 220/276
5,082,129 A 1/1992 Kramer
5,133,470 A * 7/1992 Abrams et al. ..... 215/250
5,154,308 A 10/1992 Larson
5,462,182 A 10/1995 Opresco
5,513,770 A 5/1996 Seeley et al.
5,706,963 A 1/1998 Gargione
5,725,122 A 3/1998 Murphy et al.
5,730,309 A 3/1998 Jiradejnunt et al.
5,785,203 A * 7/1998 Arshinoff et al. ..... 220/783
(Continued)

*Primary Examiner* — Mickey Yu
*Assistant Examiner* — Niki Eloshway
(74) *Attorney, Agent, or Firm* — Morris Manning & Martin, LLP; John R. Harris, Esq; Daniel E. Sineway, Esq.

(57) ABSTRACT

A pail having a cylindrical sidewall with an upper margin defining an opening generally equal to the sidewall diameter, a thread projecting outwardly from the sidewall below the upper margin, and at least one flange projecting outwardly from the sidewall below the thread, each flange including one or more radial projections and portions on either side of the radial projections extending outward from the sidewall at least as far as the radial projections. A cover having a central portion received within the opening, a mating portion extending outward from the central potion to engage the sidewall upper margin, a downwardly projecting rim including at least one inwardly directed thread to engage the thread projecting outwardly from the pail sidewall, and at least one tab integrally coupled to the downwardly projecting rim including one or more apertures corresponding to the plurality of radial projections, each tab being biased for displacement from an outwardly displaced disengaged position toward a more inward position with the radial projections being received in the apertures to lock the cover onto the top of the pail to enclose any contents of the pail, each tab including a lower edge extending sufficiently below the apertures to provide a grip allowing a manual outward force to be applied to disengage the tab apertures from the flange radial projections.

26 Claims, 5 Drawing Sheets

U.S. PATENT DOCUMENTS

| | | | | |
|---|---|---|---|---|
| 5,865,330 | A | 2/1999 | Buono | |
| 5,944,214 | A * | 8/1999 | Conti et al. | 220/304 |
| 5,960,979 | A * | 10/1999 | Van Den Brink et al. | 220/266 |
| 6,036,036 | A | 3/2000 | Bilani et al. | |
| 6,076,689 | A * | 6/2000 | Vassallo | 215/209 |
| 6,257,441 | B1 | 7/2001 | Maley | |
| 6,851,569 | B2 * | 2/2005 | Conti et al. | 220/297 |
| 6,866,162 | B2 | 3/2005 | Morris, Sr. | |
| 6,926,165 | B2 | 8/2005 | Conti | |
| 6,983,859 | B2 | 1/2006 | Azzarello | |
| 7,090,088 | B2 * | 8/2006 | von Holdt, Jr. | 220/276 |
| 2003/0085227 | A1 * | 5/2003 | Azzarello | 220/266 |
| 2004/0200839 | A1 * | 10/2004 | Conti | 220/288 |
| 2005/0023238 | A1 * | 2/2005 | Wong | 215/252 |

* cited by examiner

PAIL AND CLOSURE

BACKGROUND

The present invention is directed to unitary plastic containers generally referred to as pails and mating closures, and particularly to containers having interlocking structure between the pails and closures that include mating helical threads.

Plastic containers, commonly referred to as pails, and more particularly as wide mouth or open-headed pails, are used for packaging and transporting various materials. The various materials may be solids, liquids or pastes, aqueous or organic, acidic or alkaline, e.g., detergent solutions, lattices, foods or condiments, fine chemicals, etc. The pails are typically sized to contain between three and six gallons, but other sizes are also known. Because of inertness and toughness, plastics such as high density polyethylene, polypropylene, or other inert moldable thermoplastic resins are preferred materials. The containers are filled with the desired contents, capped, stored, and shipped. During both storage and shipment, the containers are often stacked one upon the other. After being opened, they may be reopened and closed as the contents are used. When initially filled, and when subsequently reclosed, is it generally desirable for the lid to be secured sufficiently to the pail so that the lid will not separate from the pail in the event of a fall from an elevated position.

Some pails employ lids that utilize an interference fit derived from a snap on application of the lid over the open top on the pail. Such lids commonly employ an inverted U-shaped rim having weakened segments to join arcuate engaging portions of the rim to the pail top perimeter. The lid is typically separated from the pail by first breaking one or more of the segments. Once broken, the retention of the lid on the pail becomes somewhat problematic, particularly in the event of a fall from an elevated position. Other pails employ lids also with inverted U-shaped rims have integrally molded threads so that when the pail is closed, there is mating engagement outwardly of the inner leg of the inverted U-shaped rim with a corresponding thread on an outer surface of the pail opening. These constructions are known to give relatively easy opening and closing of the lid on the pail yet equal or excel the performance of conventional closed pails utilizing interference fits from snap over tops on the pails. What is needed, however, is a conveniently molded interlocking mechanism that can be used to repeatedly secure the threaded lid to the pail at a pre-selected orientation that is easily released without the destruction of any bridging segments.

SUMMARY

A container can include a pail that has a base and a cylindrical sidewall with a lower edge that is unitarily coupled to the base. The sidewall can extend upward from the base to a sidewall upper margin that defines an opening at the top of the pail. The sidewall can have a thread projecting outwardly from the sidewall below the upper margin. The sidewall can also have a flange projecting outwardly from the sidewall below the thread. The flange can include one or more radial projections. The container can also have a cover having a central portion sized to be received within the opening at the top of the pail. The cover can include a mating portion extending outward from the central potion to engage the upper margin of the sidewall. The cover can also have a downwardly projecting rim including an inwardly directed thread dimensioned to engage the thread projecting outwardly from the sidewall. The cover can also have a tab that can be integrally coupled to the downwardly projecting rim. The tab can include one or more apertures corresponding to the radial projections on the flange. The tab can be biased for displacement from an outwardly displaced disengaged position toward a more inward position with the radial projections being received in the apertures to lock the cover onto the top of the pail to enclose any contents of the pail.

In one aspect, the flange can include a first portion on one side of the radial projections that has an outer edge extending radially outward from the sidewall at least as far as the radial projections. The flange can additionally include a second portion on a side opposite the first portion. The second portion can also include, an outer edge extending radially outward from the sidewall at least as far as the radial projections. Each of the first and second portions of the flange can include a confronting surface defining a circumferential inward edge facing the array of radial projections. Optionally, a pail can have more than one flange having some of these characteristics.

In another aspect, the tab on the cover can extend downwardly further than the downwardly projecting rim. The tab can also include circumferential outer edges that can be received between confronting surfaces of the flange. The tab can also include a portion of reduced thickness extending between the circumferential outer edges of the tab to define a hinge focusing any outward and inward displacement of the tab. The tab also can include a lower edge extending sufficiently below the apertures to provide a grip portion allowing a manual outward force to be applied to disengage the apertures from the radial projections. The reduced thickness portion of the tab can be suitably dimensioned to provide sufficient biasing of the tab to the inward locked position.

In another aspect, the mating portion of the cover can include an upwardly arched or arcuate portion between an inner step and an outer downwardly projecting rim. The upwardly arched or arcuate portion can include a radial bead extending outward and downward from a lower surface of the arcuate portion to contact the upper margin of the pail sidewall. The contact between the radial bead and the upper margin of the sidewall can be sufficient to obviate the need for any separate seal between the cover and the upper margin of the pail sidewall.

In yet another aspect, the tab can have a circumferential width slightly less than a distance of the spacing between the confronting surfaces of the flange such that central portion of the flange is adapted to snugly receive the tab at a fixed pre-selected orientation for sealably coupling the cover to the pail. The tab is pivotable and biased for displacement from an outwardly displaced disengaged position toward a more inward locked position with the central portion of the flange receiving the tab of the cover to lock the cover onto the top of the pail to enclose any contents of the pail. The first portion of the flange can have a tapered region extending from an end where the flange contacts the sidewall toward the central portion of the flange in order to provide a transitional guiding surface for the tab during attachment of the cover to the pail. The upper margin of the sidewall of the pail can be rounded and can extend radially outward further than the sidewall in order to provide an enlarged upper margin surface for enhancing the sealable contact against a lower surface of the mating portion at one or more portions along the upper margin.

Other features of the present invention and the corresponding advantages of those features will become apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF A PREFERRED EMBODIMENT

Figure 1:
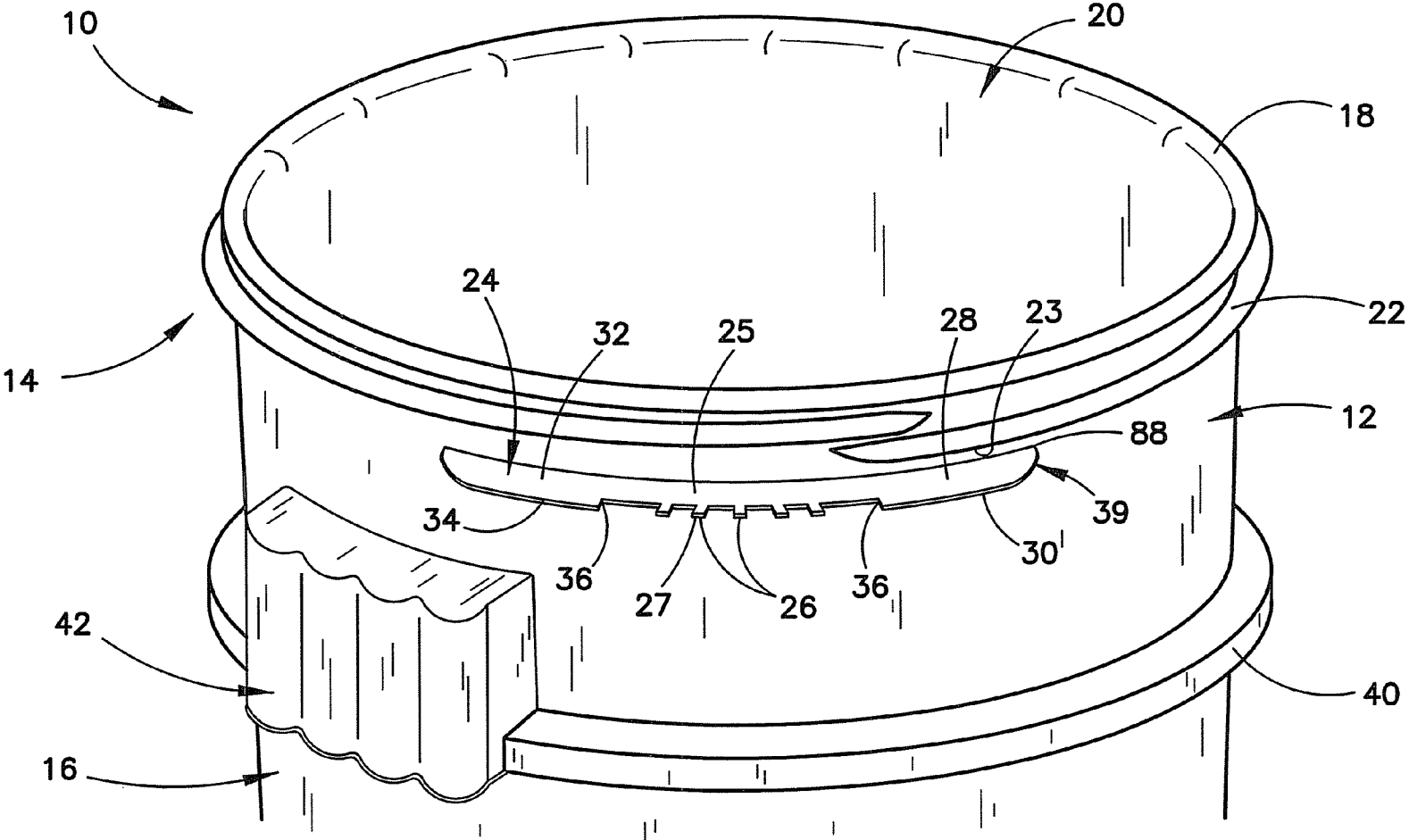
FIG. 1 is a perspective top view of a pail of a container according to one embodiment.
Figure 2:
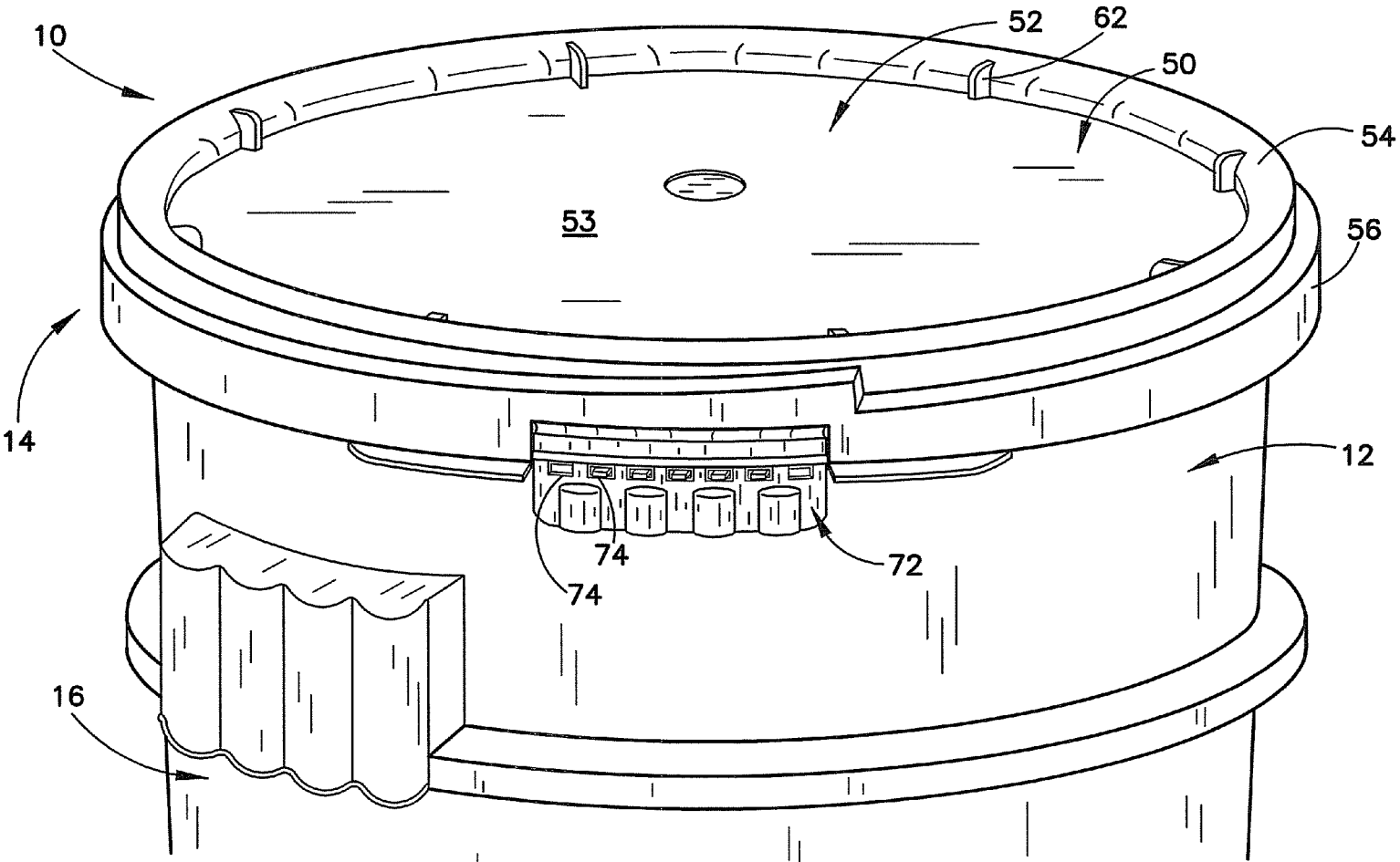
FIG. 2 is a perspective top view of the container of FIG. 1, depicting a cover coupled to the pail.

FIG. 1 shows a top 14 of a pail 12 of a container 10 according to a preferred embodiment, while FIG. 2 shows a cover 50 coupled to the top 14 of the container pail 12 according to a preferred embodiment. It is to be noted that throughout all of the figures like components are designated with like reference numerals. The pail 12 can be a wide mouth or open-headed pail, and used for packaging and transporting various materials, such as solids, liquids or pastes, aqueous or organic, acidic or alkaline, lattices, foods or condiments, fine chemicals, etc. The pail 12 is generally sized to contain between three and six gallons, but other sizes can also be incorporated. The pail and cover are generally made of a plastic, such as high density polyethylene, polypropylene, or other inert moldable thermoplastic resins.

Figure 3:
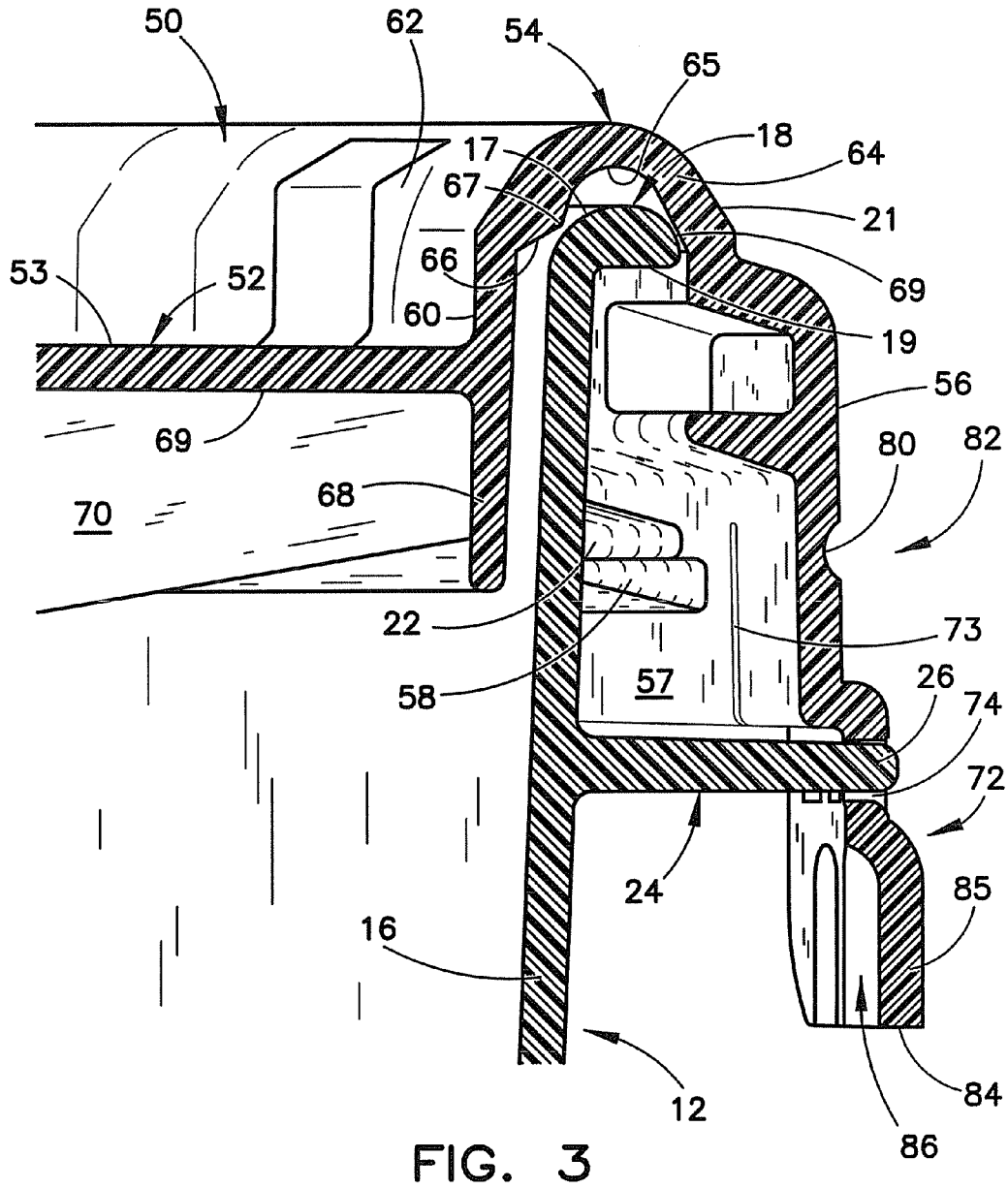
FIG. 3 is a cross-sectional view of the container coupled to the cover, depicting a tab of the cover in a locked position.

According to FIG. 1, the pail 12 has a base (not shown) and a cylindrical sidewall 16 extending upward from the base to an upper margin 18, with the sidewall 16 preferably having a lower edge (not shown) that is unitarily coupled to the base. The upper margin 18 defines an opening 20 at the top 14 of the pail 12. The upper margin 18 can be a rounded edge at the top of the sidewall. Preferably, the upper margin 18 has a radially extending portion 19 projecting outward from the sidewall 16 to define an upper margin that is thicker than the general thickness of the sidewall 16, as shown in FIG. 3. The thicker upper margin has an outer surface 17 along the top of the upper margin 16 that is rounded. The extending portion 19 of the upper margin 18 also has a radial outward end 21 that can sealably contact a portion of the cover 50 when attached.

According to FIG. 1, the sidewall 16 can have a thread 22 for threadably engaging the cover 50. The thread 22 projects outwardly from the sidewall 16 below the upper margin 18 and helically around the circumference of the sidewall 16. Additionally, the sidewall 16 can have a flange 24 for enhancing the coupling of the cover 50 to the container pail 12. The flange 24 projects outwardly from the sidewall 16 and is situated below the thread 22. The flange 24 can include first and second parallel surfaces to define a web of material therebetween having a uniform thickness, although portions of the web may also be tapered.

Portions of material from a central portion 25 of the flange 24 can be removed in order to define one or more radial projections 26 projecting outward from the central portion. In the embodiment shown, each of the radial projections 26 has edges defining a uniform lateral distance and an outward end 27 perpendicular to the edges to define a generally rectangular radial projection. In other embodiments, the radial projections 26 can include any combinations of shapes or configurations, such as having edges that are tapered or curved and/or ends that are pointed or curved. The radial projections 26 preferably have the same web thickness as the flange 24, although can be larger or smaller than the flange web.

The flange 24 can also include a first portion 28 on one side of the radial projections 26 of the central portion 25 that has an outer edge 30 extending radially outward from the sidewall 16, preferably at least as far as the radial projections 26. The flange 24 can additionally include a second portion 32 on a side opposite the first portion, having an outer edge 34 extending radially outward from the sidewall 16, preferably at least as far as the radial projections 26. Each of the first and second portions 28, 32 can include a confronting surface 36 defining a circumferential inward edge facing the radial projections 26 and connecting the outer edges 30, 34 of the first and second portions 28, 32 to the outer edge of the central portion 25. The confronting surface 36 can be essentially perpendicular relative to the central portion 25, and the more abrupt character of the confronting surface 36 can further inhibit the reverse removal process of the cover 50 from the container pail 12 from occurring under conditions normally prevalent during the use of the container 10.

As shown in FIG. 1, the outer edges 30, 34 of each of the first and second portions 28, 32 of the flange 24 are oriented preferably radially outward from the sidewall 16, and parallel with the sidewall. A portion of the first and second portions 28, 32, defined from the end that is attached to the sidewall 16 to the region of the outer edge that is parallel with the sidewall, can be tapered or angled to provide a smoother transitional guiding surface 39. The guiding surface 39 can facilitate the threadable attachment of the cover 50 to the container pail 12 as described below. Also, as shown in FIG. 1, a portion of the flange 24 can overlie a lower end 23 of the thread 22 in order to also provide a smoother transition when threadably attaching the cover 50 to the pail 12 along the thread 22, as further described below. Optionally, the pail 12 can include more than one flange 24 having some of these characteristics positioned circumferentially along the sidewall 16 at different locations and in alignment with one another. An annular ledge 40 can be situated below the flange 24 in order to provide structural support to the sidewalls 16 and also to provide a place for manipulation of the container 10, such as for transporting. Accordingly, at least one lift handle 42 can be coupled along the ledge 40, and generally two lift handles are found diametrically opposed to one another along the ledge.

According to FIG. 2, the container cover 50 has a central portion 52 sized to be received within the opening 20 at the upper margin 18 of the pail 12. The cover 50 can include a mating portion 54 extending radially outward from the central potion 52 to engage the upper margin 18 of the sidewall 16.

With additional reference to FIG. 3, the cover 50 can also have a downwardly projecting rim 56 including an inwardly directed thread 58 projecting from an inner surface 57 of the rim 56 and dimensioned to engage the sidewall thread 22. A step 60 may also be provided between the central portion 52 and the mating portion 54 of the cover 50, where a plurality of radial webs 62 couples the outer surface 53 of the central portion 52 to the step 60.

Figure 4:
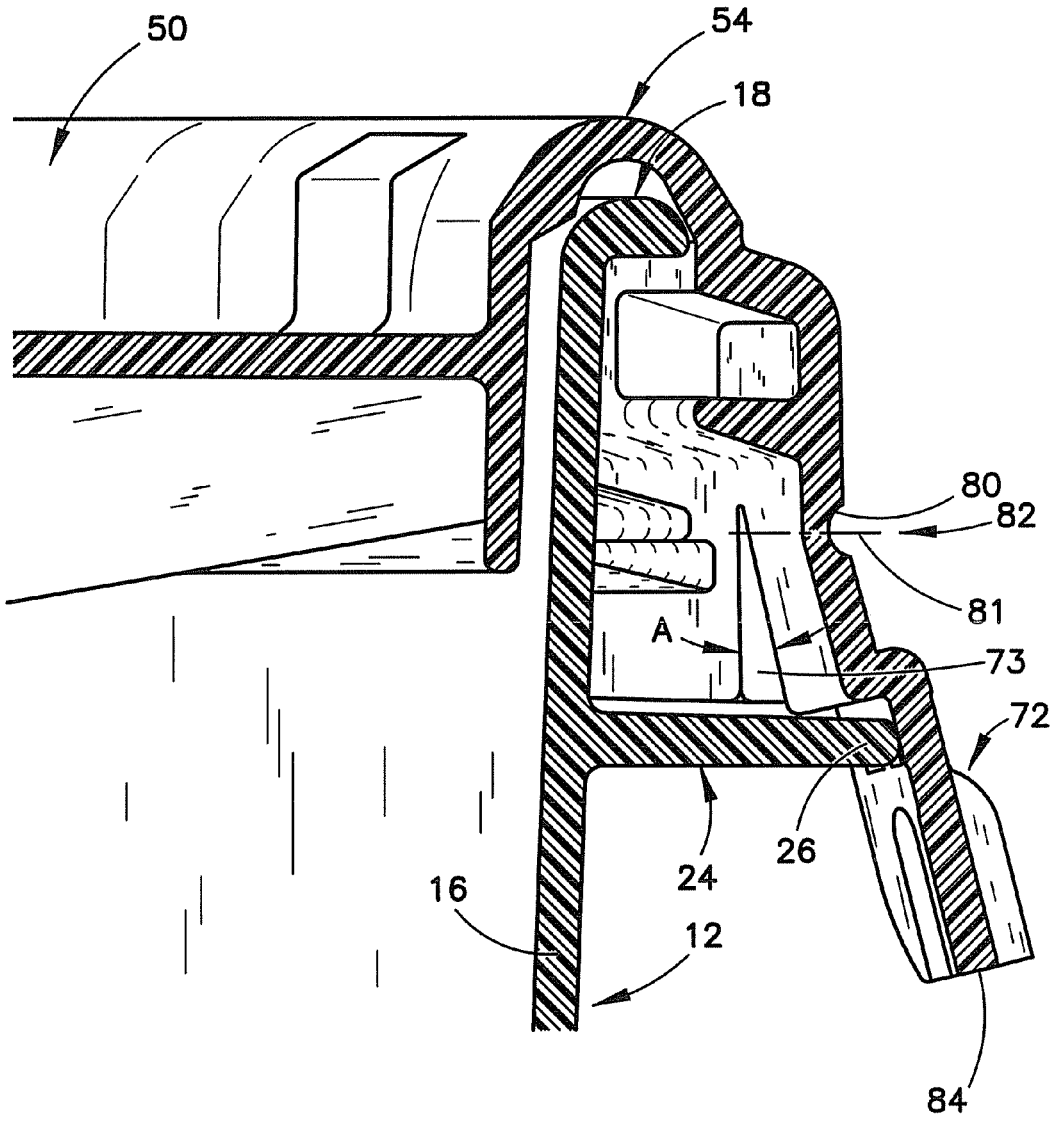
FIG. 4 is a cross-sectional view similar to FIG. 3, depicting a tab of the cover removed from a locked position.

The mating portion 54 of the cover 50 can have an arcuate portion 64 located between the step 60 and the downwardly projecting rim 56. The arcuate portion 64 can include a radial bead 66 that extends radially outward and downward from a lower surface 65 of the arcuate portion 64 for circumferentially contacting the outer surface 17 of the upper margin 18. The contact between the radial bead 66 and the upper margin 18 of the pail sidewall 16 can be sufficient to obviate the need for any separate seal between the cover 50 and the upper margin 18 of the pail 12, although a separate seal or gasket can be attached in the annular space defined between the lower surface 65 of the arcuate portion 64 and the outer surface 17 of the upper margin 18. In addition to the contact between the radial bead 66 and the upper margin 18, the extending portion 19 of the upper margin 18, and/or the outward end 21 thereof, may contact another portion of the lower surface 65 of the arcuate portion 64 of the cover 50 to enhance the sealing between the cover 50 and the upper margin 18 of the pail circumferentially along two or more lines of contact. In another aspect, the radius of curvature of the lower surface 65 of the arcuate portion 64 of the cover 50 can be smaller than the radius of curvature of the outer surface 17 of the upper margin 18 of the pail 12 for further enhancing the sealable contact along one or more lines of contact between the cover 50 and the pail 12. It is to be understood by persons of ordinary skill in the art that the relative positioning between the components in FIGS. 3 and 4 are not scaled to size and can be tighter in some circumstances than what is shown.

The cover 50 can also have a lower flange 68 extending downwardly from a lower surface 69 of the central portion 52 in alignment with the step 60. A plurality of radial webs 70 can be provided to couple the lower surface 69 of the central portion 52 to the lower flange 68. The outer diameter measured at the tip 67 of the radial bead 66 can be slightly larger than the inner diameter of the container sidewall 16. Additionally, the outer diameter of the outward end 21 of the extending portion 19 of the upper margin 18 can be approximately equal to the inner diameter of a circumferential portion 69 of the lower surface 65 that is located most radially outward.

Referring back to FIG. 2, the cover 50 can also have a tab 72 that can be integrally coupled to the downwardly projecting rim 56. The tab 72 can be separated on both ends by a slit 73 formed in the downwardly projecting rim 56. The tab 72 can include one or more apertures 74 corresponding to the number of radial projections 26 on the flange 24, although the number of apertures can be greater than the number of radial projections as shown in the figures to make the edges more pliable. Each tab aperture 74 is sufficiently sized and shaped in order to receive the radial projection 26. The tab 72 can be biased for displacement from an outwardly displaced disengaged position or unlocked position (shown in FIG. 4), toward a more inward position or locked position (shown in FIG. 3), with the radial projections 26 being received in the apertures 74 to lock the cover 50 onto the top of the pail 12 to enclose any contents of the pail. The tab 72 is preferably biased in the locked position, and the force needed to move the tab from the locked position to the disengaged or unlocked position is sufficient to inhibit a child from moving the tab under normal conditions, while permitting an adult to move the tab under normal conditions. The tab 72 on the cover 50 can extend downwardly further than the downwardly projecting rim 56.

Figure 5:
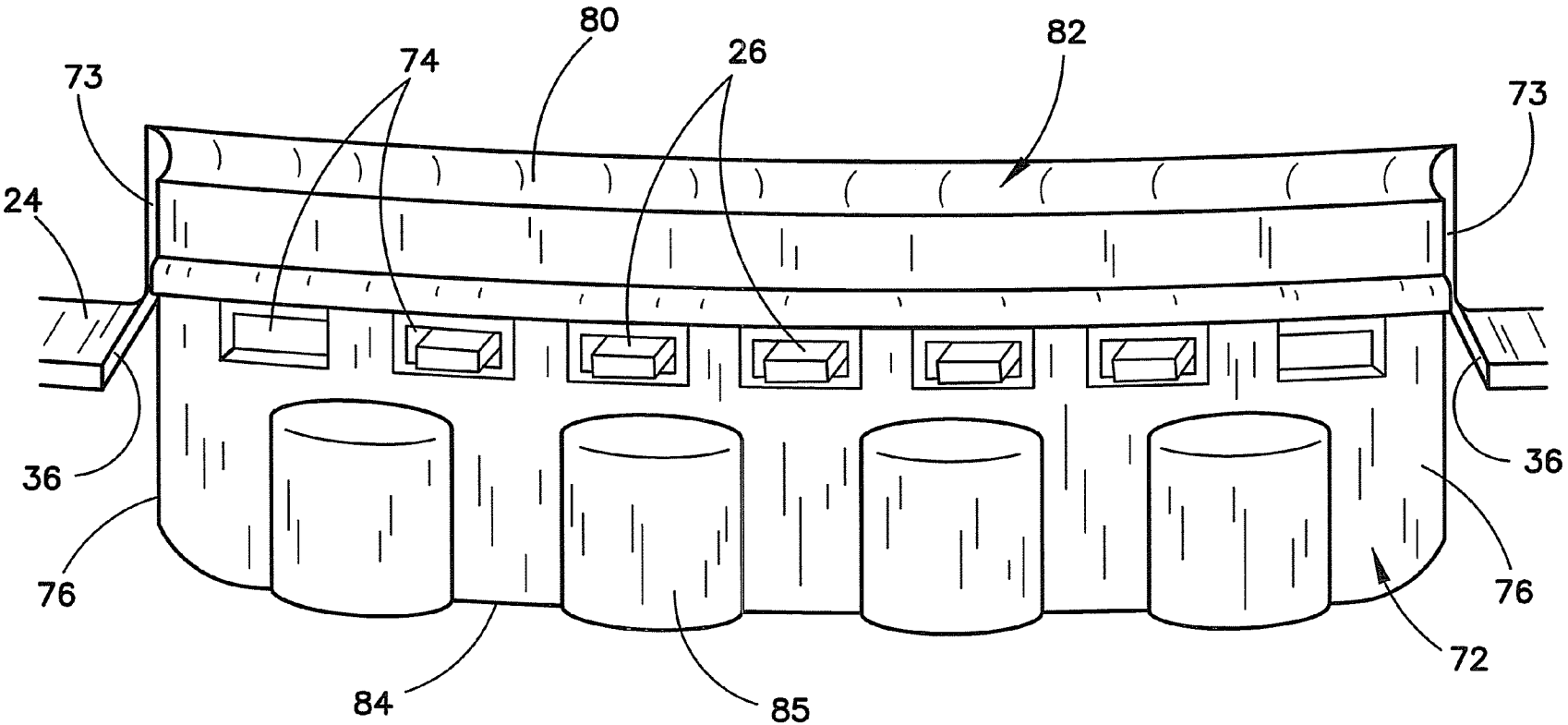
FIG. 5 is a close-up front view of a tab in a locked position.

According to FIG. 5, the tab 72 can also include circumferential outer edges 76 that can be received between confronting surfaces 36 of the flange 24. Accordingly, the confronting surfaces 36 are preferably circumferentially spaced from each other by a distance slightly larger than the circumferential width of the tab 72 defined between the circumferential outer edges 76 for permitting a snug fit. The tab 72 can also be attached to or formed with the downwardly projecting rim 56 such that a hinge 82 is formed.

FIG. 4 illustrates a cross-sectional view similar to FIG. 3 with the cover 50 positioned slightly rotated in the loosening direction such that the radial projections 26 are removed from the tab apertures 74 and the ends 27 of the radial projections 26 are contacting the interior surface of the tab 72. In one aspect, the tab 72 can include a reduced thickness portion 80 extending between the circumferential outer edges 76 to define the hinge 82 in order to focus any outward and inward pivotal displacement of the tab 72 with respect to line 81. The tab 72 also can include a lower edge 84 extending sufficiently below the apertures 74 to provide a grip portion for allowing a manual outward force to be applied to disengage the apertures 74 of the tab 72 from the radial projections 26 of the pail flange 24. The lower edge can include one or more bulging portions 85 having an inner space 86 that can be sized and shaped to receive a portion of fingers of the operator. According to FIG. 4, the tab 72 can be pivoted about the line 81 at an angle A sufficient to provide enough clearance for the interior surface of the tab 72 to ride against the ends 27 of the radial projections 26 when the cover 50 is being removed. The angle A can be any angle, such as approximately 0-20 degrees, sufficient to widen the slit 73 that separates the tab from the downwardly projecting rim 56 suitably for the outward displacement of the tab.

In general, the container 10 is filled with the desired contents, capped, stored, and shipped. During both storage and shipment, the container 10 is often stacked one upon another. After being opened, the container 10 may be reopened and closed as the contents are used. When initially filled, and when subsequently reclosed, the cover 50 can be secured sufficiently to the pail 12 so that the cover 50 will not separate from the pail 12 in the event of a fall from an elevated position.

With reference to all of the figures, to close the container 10 and thus sealably couple the cover 50 to the pail 12, the operator can centrally place the cover 50 over the opening 20 of the pail so that the mating portion 54 of the cover engages the upper margin 18 of the pail. The cover 50 can then be repositioned so that the upper end at the beginning of the cover thread 58 engages the lower end 23 at the beginning of the sidewall thread 22. Once positioned properly, the cover 50 can be rotated relative to the pail 12 in a tightening direction until the first confronting circumferential outer edge 76 of the tab 72 contacts the end 88 of the first portion 28 of the flange 24. The cover 50 can continue to be rotated relative to the pail 12 in the tightening direction so that the inner surface of the tab 72 contacts and rides along the guiding surface 39 and along the outer edge 30, thereby causing the tab 72 to pivot at the hinge 82 for outward pivotal displacement similar to what is shown in FIG. 4. The cover 50 can still be rotated relative to the pail 12 in the tightening direction until the tab 72 is positioned between the confronting surfaces 36 of the flange 24, where in some instances a manual outward force can then be applied to the lower edge 84 to manually displace the tab 72 further outward to provide sufficient clearance for aligning the tab apertures 74 with the radial projections 26. The tab 72 can then be displaced radially inward to the locked position shown in FIG. 3, where the radial projections 26 are received in the apertures 74 to lock the cover 50 onto the top of the pail 12 to enclose any contents of the pail. By suitably dimensioning the reduced thickness portion 80, sufficient memory may be retained to cause naturally the required radial inward displacement of the tab 72 when the cover is rotated to the locked position. The components of the cover 50 and the pail 12 are sized such that the circumferential position of the confronting surfaces 36 of the flange 24 in relation to the circumferential position of the tab 72 defines a fixed pre-selected orientation for sealably coupling the cover 50 to the pail 12. The pre-selected orientation is selected so that when threadably attaching the cover to the pail to the pre-selection position, a suitable downward pressure can be applied with at least the radial bead 66 of the cover 50 circumferentially against the upper margin 18 of the pail 12, thereby sealing along the line of contact. To open the container 10 and remove the cover 50 from the pail 12, the reverse process may be employed as understood by persons of ordinary skill in the art.

While these features have been disclosed in connection with the illustrated preferred embodiment, other embodiments of the invention will be apparent to those skilled in the art that come within the spirit of the invention as defined in the following claims.

The invention claimed is:

1. A container comprising: a pail having a bottom and a cylindrical sidewall, an upper margin of the sidewall defining an opening, a thread projecting outwardly from the sidewall below the upper margin, and a flange projecting outwardly from the sidewall below the thread, the flange including at least one radial projection, wherein the thread projecting outwardly from the sidewall below the upper margin includes an upper end and a lower end, the lower end overlying a portion of the flange that includes the at least one radial projection; and a cover having a central portion sized to be received within the opening, a mating portion extending outward from the central potion to engage the upper margin of the sidewall, a downwardly projecting rim including an inwardly directed thread corresponding to the thread projecting outwardly from the sidewall, and a tab integrally coupled to the downwardly projecting rim including at least one aperture corresponding to the at least one radial projection, the tab being biased for displacement from an outwardly displaced disengaged position toward a more inward position with the at least one radial projection being received in the at least one aperture to lock the cover onto the top of the pail to enclose any contents of the pail.

2. The container of claim 1, wherein the flange includes a first portion on one side of the at least one radial projection, the first portion including an outer edge extending radially outward from the sidewall at least as far as the at least one radial projection.

3. The container of claim 2, wherein the flange includes a second portion on a side opposite the first portion, the second portion including an outer edge extending radially outward from the sidewall at least as far as the at least one radial projection.

4. The container of claim 3, wherein each of the first and second portions of the flange include a confronting surface defining a circumferential inward edge of the first and second portions, the confronting surfaces being spaced from each other by a distance slightly larger than the tab circumferential width.

5. The container of claim 4, wherein the tab extends downwardly further than the downwardly projecting rim, and includes circumferential outer edges that can be received between the confronting surfaces of the flange.

6. The container of claim 5, wherein the tab includes a portion of reduced thickness extending between the circumferential outer edges of the tab.

7. The container of claim 1, wherein the tab includes a lower edge extending sufficiently below the at least one aperture to provide a grip adapted to allow a manual outward force to be applied to disengage the at least one aperture from the at least one radial projection.

8. A container comprising: a pail having a bottom and a cylindrical sidewall, an upper margin of the sidewall defining an opening, at least one thread projecting outwardly from the sidewall below the upper margin, and at least one flange projecting outwardly from the sidewall below the at least one thread, each flange including a plurality of radial projections and a first portion on one side of the plurality of radial projections, the first portion including an outer edge extending radially outward from the sidewall at least as far as the radial projections; and a cover having a central portion sized to be received within the opening, a mating portion extending outward from the central potion to engage the upper margin of the sidewall, a downwardly projecting rim including at least one inwardly directed thread to engage the at least one thread projecting outwardly from the sidewall, and at least one tab integrally coupled to the downwardly projecting rim including a plurality of apertures corresponding to the plurality of radial projections, each tab being biased for displacement from an outwardly displaced disengaged position toward a more inward position with the plurality of radial projections being received in the plurality of apertures to lock the cover onto the top of the pail to enclose any contents of the pail, each tab including a lower edge extending sufficiently below the plurality of apertures to provide a grip adapted to allow a manual outward force to be applied to disengage the plurality of apertures from the plurality of radial projections.

9. The container of claim 8, wherein each flange includes a second portion on a side opposite the first portion, the second portion including an outer edge extending radially outward from the sidewall at least as far as the radial projections.

10. The container of claim 9, wherein each of the first and second portions of each flange include a confronting surface defining a circumferential inward edge of the first and second portions, the confronting surfaces being spaced from each other by a distance slightly larger than the corresponding tab circumferential width.

11. The container of claim 10, wherein each tab extends downwardly further than the downwardly projecting rim, and includes circumferential outer edges that can be received between the confronting surfaces of the flange.

12. The container of claim 11, wherein each tab includes a portion of reduced thickness extending between the circumferential outer edges of the tab.

13. The container of claim 8, further comprising an annular ledge situated below the at least one flange.

14. The container of claim 13, further comprising at least one handle coupled to the ledge.

15. The container of claim 8, further comprising a step between the central portion and the mating portion of the cover, and a plurality of radial webs coupling an outer surface of the central portion to the step.

16. The container of claim 15, wherein the mating portion of the cover comprises an arcuate portion between the step and the downwardly projecting rim including a radial bead extending outward and downward from a lower surface of the arcuate portion to contact the upper margin of the sidewall.

17. The container of claim 15, further comprising a lower flange extending downwardly from a lower surface of the central portion in alignment with the step, and a plurality of radial webs coupling the lower surface of the central portion to the lower flange.

18. A container comprising:

a pail having a bottom and a cylindrical sidewall, an upper margin of the sidewall defining an opening, a thread projecting outwardly from the sidewall below the upper margin, and a flange projecting outwardly from the sidewall below the thread, the flange generally having an outer edge along a first portion, a second portion, and a central portion therebetween, where the outer edge of each of the first and second portions extends outward further than the outer edge of the central portion in order to define a confronting surface defining a circumferential inward edge of the first and second portions;

and a cover having a central portion sized to be received within the pail opening, a mating portion extending outward from the central potion to engage the upper margin of the pail sidewall, a downwardly projecting rim including an inwardly directed thread corresponding to the pail sidewall thread for threadably attaching the cover to the pail, and a tab integrally coupled to the downwardly projecting rim, the tab having a circumferential width slightly less than a distance of the spacing between the confronting surfaces of the flange such that central portion of the flange is adapted to snugly receive the tab at a fixed pre-selected orientation for sealably coupling the cover to the pail, the tab being pivotable and biased for displacement from an outwardly displaced disengaged position toward a more inward locked position with the central portion of the flange receiving the tab of the cover to lock the cover onto the top of the pail to enclose any contents of the pail.

19. The container of claim 18, wherein the first portion of the flange has a tapered region extending from an end where the flange contacts the sidewall toward the flange central portion in order to provide a transitional guiding surface for the tab during attachment of the cover to the pail.

20. The container of claim 18, wherein the upper margin of the sidewall of the pail is rounded and extends radially outward further than the sidewall in order to provide an enlarged upper margin surface for sealably contacting against a lower surface of the mating portion.

21. The container of claim 18, wherein the mating portion of the cover comprises an arcuate portion between the cover central portion and the downwardly projecting rim including a radial bead extending outward and downward from the lower surface of the mating portion to sealably contact circumferentially along an inner portion of the upper margin of the sidewall, and the inner surface of the mating portion is configured to provide sealably contact circumferentially along an outer portion of the upper margin of the sidewall.

22. The container of claim 18, wherein the tab includes a reduced thickness portion along the coupling between the tab and the downwardly projecting rim for pivotable movement of the tab, the reduced thickness portion being suitably dimensioned to provide biasing of the tab to the inward locked position.

23. A container comprising: a pail having a bottom and a cylindrical sidewall, an upper margin of the sidewall defining an opening, a thread projecting outwardly from the sidewall below the upper margin, and a flange projecting outwardly from the sidewall below the thread, the flange including at least one radial projection; and a cover having a central portion sized to be received within the opening, a mating portion extending outward from the central potion to engage the upper margin of the sidewall, a downwardly projecting rim including an inwardly directed thread corresponding to the thread projecting outwardly from the sidewall, and a tab integrally coupled to the downwardly projecting rim including at least one aperture corresponding to the at least one radial projection, the tab being biased for displacement from an outwardly displaced disengaged position toward a more inward position with the at least one radial projection being received in the at least one aperture to lock the cover onto the top of the pail to enclose any contents of the pail, wherein the flange includes a first portion on one side of the at least one radial projection, the first portion including an outer edge extending radially outward from the sidewall at least as far as the at least one radial projection, wherein the flange includes a second portion on a side opposite the first portion, the second portion including an outer edge extending radially outward from the sidewall at least as far as the at least one radial projection, wherein each of the first and second portions of the flange include a confronting surface defining a circumferential inward edge of the first and second portions, the confronting surfaces being spaced from each other by a distance slightly larger than the tab circumferential width, wherein the tab extends downwardly further than the downwardly projecting rim, and includes circumferential outer edges that can be received between the confronting surfaces of the flange.

24. The container of claim 23, wherein the thread projecting outwardly from the sidewall below the upper margin includes an upper end and a lower end, the lower end overlying a portion of the flange that includes the at least one radial projection.

25. The container of claim 23, wherein the tab includes a portion of reduced thickness extending between the circumferential outer edges of the tab.

26. The container of claim 23, wherein the tab includes a lower edge extending sufficiently below the at least one aperture to provide a grip adapted to allow a manual outward force to be applied to disengage the at least one aperture from the at least one radial projection.

* * * * *